US007018772B2

(12) United States Patent
Simpson et al.

(10) Patent No.: US 7,018,772 B2
(45) Date of Patent: Mar. 28, 2006

(54) METHOD OF TRANSFERRING A PROTECTIVE OVERCOAT TO A DYE-DONOR ELEMENT

(75) Inventors: William H. Simpson, Pittsford, NY (US); Robert F. Mindler, Churchville, NY (US); Jacob J. Hastreiter, Spencerport, NY (US)

(73) Assignee: Eastman Kodak Company, Rochester, NY (US)

( * ) Notice: Subject to any disclaimer, the term of this patent is extended or adjusted under 35 U.S.C. 154(b) by 190 days.

(21) Appl. No.: 10/669,965

(22) Filed: Sep. 24, 2003

(65) Prior Publication Data

US 2005/0064320 A1 Mar. 24, 2005

(51) Int. Cl.

| | |
|---|---|
| ***B41M 7/00*** | (2006.01) |
| ***B41M 5/38*** | (2006.01) |
| ***G03C 11/08*** | (2006.01) |
| ***G03C 11/10*** | (2006.01) |

(52) U.S. Cl. ..... 430/201; 430/200; 430/961; 156/230; 156/234; 156/235; 156/238; 156/240; 503/227

(58) Field of Classification Search ..... 430/200, 430/201, 961; 156/230, 234, 235, 238, 240; 503/227

See application file for complete search history.

(56) References Cited

U.S. PATENT DOCUMENTS

| | | | | |
|---|---|---|---|---|
| 4,621,271 | A | 11/1986 | Brownstein | |
| 5,332,713 | A * | 7/1994 | Oldfield et al. | 503/227 |
| 6,362,132 | B1 * | 3/2002 | Simpson et al. | 503/227 |
| 2003/0176283 | A1 * | 9/2003 | Simpson et al. | 503/227 |
| 2005/0064319 | A1 * | 3/2005 | Simpson et al. | 430/199 |

FOREIGN PATENT DOCUMENTS

WO WO 2005/032842 * 4/2005

* cited by examiner

*Primary Examiner*—Richard L. Schilling
(74) *Attorney, Agent, or Firm*—Chris P. Konkol; Kathleen Neuner Manne

(57) ABSTRACT

This invention relates to a method for transferring a protective overcoat for a thermal print wherein the protective overcoat is applied to a dye-donor element under predesigned conditions after thermal dye transfer, the dye-donor element comprising patches of dye for transfer to a thermal print to provide a protective layer thereon. In particular, the invention improves the process of providing an improved level of gloss to the transferred protective overcoat. The method involves a preselected duration between printing and peeling the transferable laminate patch, respectively, to and from the donor. The invention is particularly advantageous at lower line times, faster printing, for thermal prints with high gloss.

17 Claims, 1 Drawing Sheet

METHOD OF TRANSFERRING A PROTECTIVE OVERCOAT TO A DYE-DONOR ELEMENT

FIELD OF THE INVENTION

This invention relates to a method for transferring a protective overcoat for a thermal print wherein the protective overcoat is applied to a dye-donor element under predesigned conditions after thermal dye transfer, the dye-donor element comprising patches of dyes for transfer to a thermal print to provide a protective layer thereon. In particular, the invention improves the process of providing an improved level of gloss to the transferred protective overcoat.

BACKGROUND OF THE INVENTION

In recent years, thermal transfer systems have been developed to obtain prints from pictures that have been generated electronically from a color camera. According to one way of obtaining such prints, an electronic picture is first subjected to color separation by color filters. The respective color-separated images are then converted into electrical signals. These signals are then operated on to produce cyan, magenta and yellow signals. These signals are then transmitted to a thermal printer. To obtain the print, a cyan, magenta or yellow dye-donor element is placed face-to-face with a dye-receiving element. The two are then inserted between a thermal printing head and a platen roller. A line-type thermal printing head is used to apply heat from the back of the dye-donor sheet. The thermal printing head has many heating elements and is heated up sequentially in response to one of the cyan, magenta and yellow signals. The process is then repeated for the other two colors. A color hard copy is thus obtained which corresponds to the original picture viewed on a screen. Further details of this process and an apparatus for carrying it out are contained in U.S. Pat. No. 4,621,271, the disclosure of which is hereby incorporated by reference.

Thermal prints are susceptible to retransfer of dyes to adjacent surfaces and to discoloration by fingerprints. This is due to dye being at the surface of the dye-receiving layer of the print. These dyes can be driven further into the dye-receiving layer by thermally fusing the print with either hot rollers or a thermal head. This will help to reduce dye retransfer and fingerprint susceptibility, but does not eliminate these problems. However, the application of a protection overcoat will practically eliminate these problems. This protection overcoat is applied to the receiver element by heating in a likewise manner after the dyes have been transferred. The protection overcoat will improve the stability of the image to light fade and oil from fingerprints.

In a thermal dye transfer printing process, it is desirable for the finished prints to compare favorably with color photographic prints in terms of image quality. The look of the final print is very dependent on the surface texture and gloss. Typically, color photographic prints are available in surface finishes ranging from very smooth, high gloss to rough, low gloss matte.

The transferable protection layer of the dye donor that has a glossy finish is manufactured by a gravure coating process between the temperatures of 55° F. and 120° F., preferably between 65° F. and 100° F. A coating melt or solution is prepared from a solvent soluble polymer, a colloidal silica and organic particles and is transferred in the liquid state from the etching of the gravure cylinder to the dye donor support. The coated layer is dried by evaporating the solvent.

The transferable protection layer is usually one of at least two patches on the dye donor. It is transferred after printing an image from the dye donor to the surface of the dye receiving layer of the receiver by heating the backside of the donor causing the transferable protection layer to adhere to the dye receiving layer. The dye donor is peeled away from the receiver after cooling resulting in transfer of the protective layer. The surface of the transferred protective layer adhered to the dye-receiving layer has a measurable 60 degree gloss that is usually between 65 and 85 gloss units.

It has been found that the gloss on a laminated print decreases as the printing line time decreases, which is a problem as printing times become faster.

SUMMARY OF THE INVENTION

A solution to this problem is achieved in accordance with this invention that relates to a process for transferring a protection layer or overcoat material from a dye-donor element to a printed receiver after thermal dye transfer to the receiver. In one embodiment, the dye-donor element comprises a support having thereon at least one dye layer area comprising an image dye in a binder and another area comprising a transferable protection layer, the transferable protection layer area being approximately equal in size to the dye layer area. In one embodiment, the transferable protection layer contains inorganic particles, a polymeric binder, and organic particles.

By use of the present process, a dye-donor element is provided containing a transferable protection layer that is capable of giving a higher gloss to an image after transfer.

In particular, predesigned adjustment of the time between applying the protection layer to a thermal print and then peeling them apart has been found to provide increased gloss to the print. A means for stripping the portion of protection overcoat (adhered to the thermally printed receiver by the thermal-print head) from the rest of the dye-donor element provides improved results especially at faster print times. The time of peeling can be adjusted by the relative position of the means for stripping, such as a stripper plate, relative to the print head or other parts of the thermal printer.

Increased gloss of a glossy print is an advantage in the physical quality of the print. This is particularly advantageous at lower line times, faster printing. In one embodiment, the method of the invention employed with respect to a protection overcoat transferred from the fourth patch laminate of a thermal donor results in a higher gloss on the print after the laminate has been transferred to the receiver when compared to the control with current methods.

DETAILED DESCRIPTION OF THE INVENTION

Figure 1:
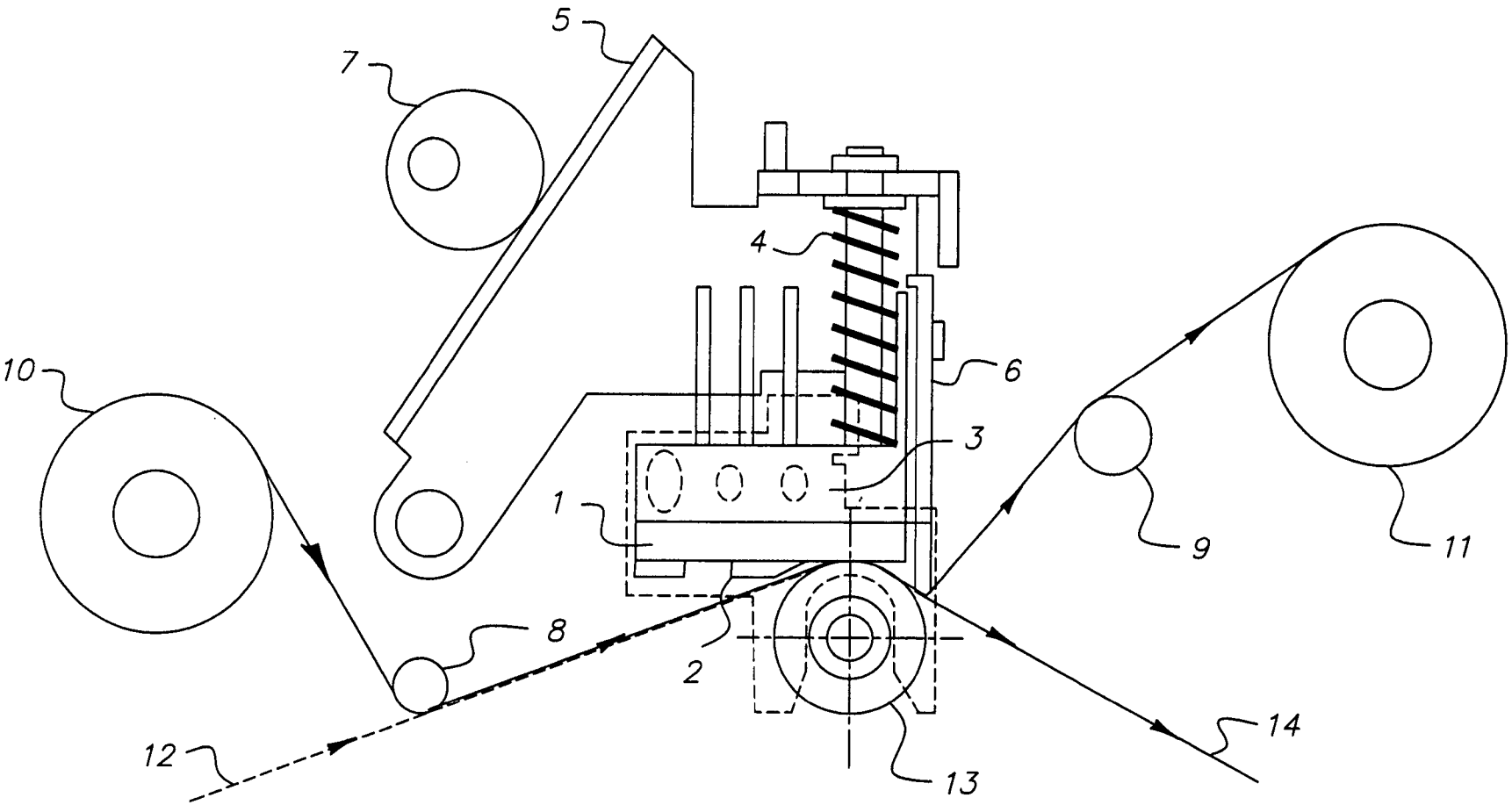
FIG. 1 shows a side view of one embodiment of a thermal printing head and peeling plate interface that can be used in accordance with the process of the present invention.

As indicated above, the present invention relates to a process of forming a protection layer with an improved level of gloss on top of a thermal dye transfer image comprising: (a) imagewise-heating a dye-donor element comprising a support having thereon a dye layer comprising an image dye in a binder, said dye donor being in contact with a dye-receiving element, thereby transferring a dye image to said dye-receiving element at a line time of 0.4 to 2 milliseconds, preferably 0.5 to 1.4 milliseconds, more preferably 0.5 to 1 milliseconds, to form said dye transfer image; and (b) thermally transferring a protection layer on top of said transferred dye image at a line time (not necessarily the same line time as the dye image) of 0.4 to 2 milliseconds, preferably 0.5 to 1.4 milliseconds, more preferably 0.5 to 1 milliseconds, wherein a means for stripping the protection layer from the dye-donor element is adjusted so that the distance the donor and receiver travel before peeling is preselected such that the time from printing of a line to peeling of the line, when the dye donor substrate is separated from the protection layer adhered to said dye-receiving element, is 68.21 to 69.00 millisec, preferably 68.25 to 68.75 millisec. In a preferred embodiment, the angle between donor and receiver from the thermal head to the stripping plate (taking into account the radius of the platen roller) from a true vertical axis is between 0 and 32.14 degrees, preferably 1.19 to 2.39 degrees.

The means for stripping the protection layer from the dye-donor element can be a printer stripper plate or equivalent means. One embodiment of such a printer stripper plate is described below with respect to FIG. 1.

Preferably, the printing line time is 2 millisecond or less, more preferably 1.5 or less, most preferably, 1.2 millisecond or less per line. The line time can be as low as 0.5 milliseconds. Thus, previous line-times of about 4 milliseconds are relatively slow. Such fast line times allow printing of at least or greater than 300 lines per inch, preferably at least or greater than 600 lines per inch.

In a preferred embodiment of the invention, the dye-donor element is a multicolor element comprising repeating color patches of yellow, magenta and cyan image dyes, respectively, dispersed in a binder, and a patch containing the protection layer. Preferably, the protection layer or overcoat is transferred over an image made from a single thermal head. In one embodiment, the invention is used in a kiosk.

In another embodiment of the invention, the dye-donor element is a monochrome element and comprises repeating units of two areas, the first area comprising a layer of one image dye dispersed in a binder, and the second area comprising the protection layer.

In still another embodiment of the invention, the dye-donor element is a black-and-white element and comprises repeating units of two areas, the first area comprising a layer of a mixture of image dyes dispersed in a binder to produce a neutral color, and the second area comprising the protection layer.

The present invention provides a protection overcoat layer on a thermal print by uniform application of heat using a thermal head. After transfer to the thermal print, the protection layer provides superior protection against image deterioration due to exposure to light, common chemicals, such as grease and oil from fingerprints, and plasticizers from film album pages or sleeves made of poly(vinyl chloride). The protection layer is generally applied at a coverage of at least about 0.03 $g/m^2$ to about 1.7 $g/m^2$ to obtain a dried layer of preferably less than 1 μm.

As noted above, the transferable protection layer comprises inorganic and organic particles dispersed in a polymeric binder. Many such polymeric binders have been previously disclosed for use in protection layers. Examples of such binders include those materials disclosed in U.S. Pat. No. 5,332,713, the disclosure of which is hereby incorporated by reference. In a preferred embodiment of the invention, poly(vinyl acetal) is employed.

Preferably, the transferable protection layer area being approximately equal in size to the dye layer area, wherein the transferable protection layer comprises poly(vinyl formal), poly(vinyl benzal) or poly(vinyl acetal) containing at least about 5 mole % hydroxyl.

In a preferred embodiment of the invention, the protection layer comprises:

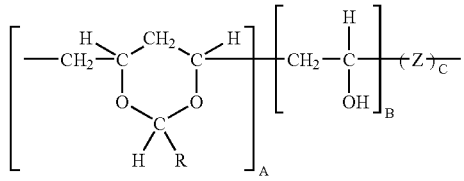

wherein:

R is H, $CH_3$ or $C_6H_5$;

A is at least about 25 mole percent;

B is from about 5 to about 75 mole percent;

Z is another monomer different from A and B such as vinyl acetate, vinyl chloride, styrene, methyl methacrylate, butyl acrylate, isopropyl acrylamide, and acrylate ionomer;

A+B is at least about 65 mole percent; and

A+B+C=100.

Preferably, the Tg of the surface material on the overcoat in contact with the print is in the range of 100 to 125° C., more preferably below 120° C., most preferably 110 to 120° C. Suitably, the protective overcoat is heated by the thermal head at a temperature of 130 to 150° C. This allows a gloss level of at least 70.

The present invention preferably provides a protective overcoat layer applied to a thermal print by uniform application of heat using a single thermal head.

In use, yellow, magenta and cyan dyes are thermally transferred from a dye-donor element to form an image on the dye-receiving sheet. The thermal head is then used to transfer a clear protective layer, from another clear patch on the dye-donor element or from a separate donor element, onto the imaged receiving sheet by uniform application of heat. The clear protection layer adheres to the print and is released from the donor support in the area where heat is applied.

The clear protective layer adheres to the print and is released from the donor support in the area where heat is applied.

Binder materials for the protective overcoat include, for example, but are not limited to the following:

1) Poly(vinyl benzal) in 2-butanone solvent.

2) Poly(vinyl acetal) KS-5 (Sekisui Co) (26 mole % hydroxyl, 74 mole % acetal) in a 3-pentanone/methanol solvent mixture (75/25).

3) Poly(vinyl acetal) KS-3 (Sekisui Co) (12 mole % hydroxyl, 4 mole % acetate, 84 mole % acetal) in a 3-pentanone/methanol solvent mixture (75/25).

4) Poly(vinyl acetal) KS-1 (Sekisui Co) (24 mole % hydroxyl, 76 mole % acetal) in a 3-pentanone/methanol solvent mixture (75/25).

5) Poly(vinyl acetal) (26 mole % hydroxyl, 74 mole % acetal) in a 3-pentanone/methanol solvent mixture (75/25).

6) Poly(vinyl acetal) (29 mole % hydroxyl, 71 mole % acetal) in a 3-pentanone/methanol solvent mixture (75/25).

7) Poly(vinyl acetal) (56 mole % hydroxyl, 44 mole % acetal) in a 3-pentanone/methanol solvent mixture (75/25).

8) Poly(vinyl acetal) (15 mole % hydroxyl, 77 mole % acetal, 8 mole % acetate) in a methanol/3-pentanone solvent mixture (75/25).

9) Poly(vinyl acetal) (20 mole % hydroxyl 51 mole % acetal, 29 mole % acetate) in a methanol/3-pentanone solvent mixture (75/25).

10) Poly(vinyl acetal) (24 mole % hydroxyl, 76 mole % acetal) in a methanol/3-pentanone solvent mixture (75/25).

11) Poly(vinyl acetal) (44 mole % hydroxyl, 43 mole % acetal, 13 mole % acetate) in a methanol/water solvent mixture (75/25).

12) Poly(vinyl acetal) (65 mole % hydroxyl, 35 mole % acetal) in a methanol/water solvent mixture (75/25).

13) Poly(vinyl acetal) (18 mole % hydroxyl, 64 mole % acetal, 18 mole % acetate) in a methanol/3-pentanone solvent mixture (75/25).

14) Poly(vinyl acetal) (16 mole % hydroxyl, 84 mole % acetal) in a methanol/3-pentanone solvent mixture (75/25).

15) Poly(vinyl formal) (Formvar®, Monsanto Co.) (5% hydroxyl, 82% formal, 13% acetate) in a toluene/3A alcohol/water mixture (57/40/3).

Inorganic particles are present in the protection layer used in the method of the invention. There may be used, for example, silica, titania, alumina, antimony oxide, clays, calcium carbonate, talc, etc. as disclosed in U.S. Pat. No. 5,387,573. In a preferred embodiment of the invention, the inorganic particles are silica. The inorganic particles improve the separation of the laminated part of the protection layer from the unlaminated part upon printing.

In a preferred embodiment of the method, the protection layer contains from about 5% to about 60% by weight inorganic particles, from about 25% to about 80% by weight polymeric binder and from about 5% to about 60% by weight of the organic particles. The protection layer may further comprise a UV absorber or gloss-enhancing agent as described in commonly assigned copending application U.S. Ser. No.07/682,798 hereby incorporated by reference in its entirety.

Any dye can be used in the dye layer of the dye-donor element used in the method of the present invention provided it is transferable to the dye-receiving layer by the action of heat. Especially good results have been obtained with sublimable dyes. Examples of sublimable dyes include anthraquinone dyes, e.g., Sumikaron Violet RS® (Sumitomo Chemical Co., Ltd.), Dianix Fast Violet 3R FS® (Mitsubishi Chemical Industries, Ltd.), and Kayalon Polyol Brilliant Blue N BGM® and KST Black 146® (Nippon Kayaku Co., Ltd.); azo dyes such as Kayalon Polyol Brilliant Blue BM®, Kayalon Polyol Dark Blue 2BM®, and KST Black KR® (Nippon Kayaku Co., Ltd.), Sumikaron Diazo Black 5G® (Sumitomo Chemical Co., Ltd.), and Miktazol Black 5GH® (Mitsui Toatsu Chemicals, Inc.); direct dyes such as Direct Dark Green B® (Mitsubishi Chemical Industries, Ltd.) and Direct Brown M® and Direct Fast Black D® (Nippon Kayaku Co. Ltd.); acid dyes such as Kayanol Milling Cyanine 5® (Nippon Kayaku Co. Ltd.); basic dyes such as Sumiacryl Blue 6G® (Sumitomo Chemical Co., Ltd.), and Aizen Malachite Green® (Hodogaya Chemical Co., Ltd.);

(magenta)

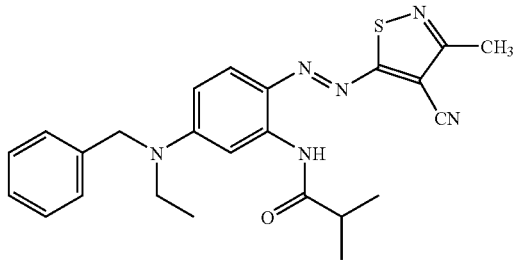

(magenta)

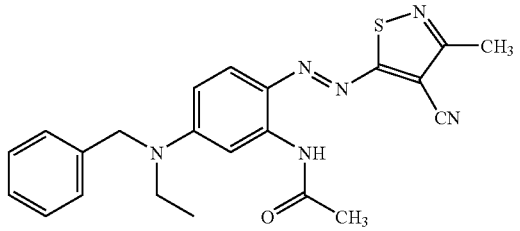

(magenta)

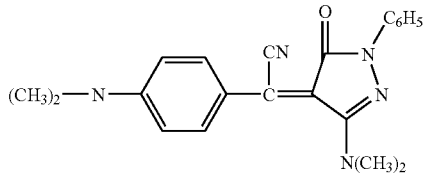

(yellow)

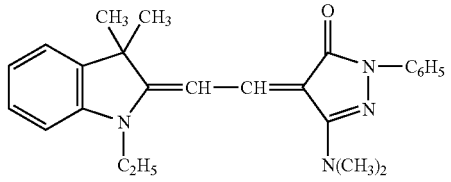

(yellow)

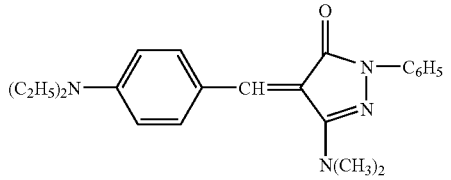

(cyan)

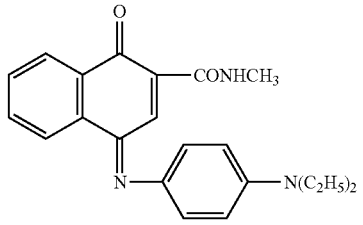

(cyan)

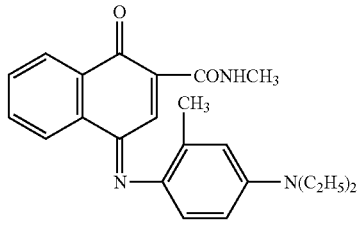

-continued (cyan)

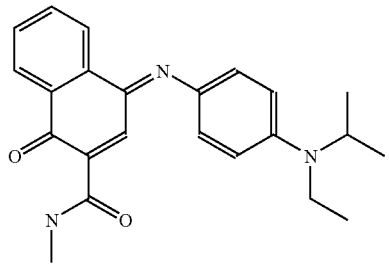

or any of the dyes disclosed in U.S. Pat. No. 4,541,830, the disclosure of which is hereby incorporated by reference. Other dyes are disclosed in U.S. Pat. Nos. 4,698,651; 4,695,287; 4,701,439; 4,757,046; 4,743,582; 4,769,360 and 4,753,922, the disclosures of which are hereby incorporated by reference. The above dyes may be employed singly or in combination to obtain a monochrome. The dyes may be used at a coverage of from about 0.05 to about 1 g/m$^2$ and are preferably hydrophobic.

A dye-barrier layer may be employed in the dye-donor elements used in the invention to improve the density of the transferred dye. Such dye-barrier layer materials include hydrophilic materials such as those described and claimed in U.S. Pat. No. 4,716,144.

The dye layers and protection layer of the dye-donor element may be coated on the support or printed thereon by a printing technique such as a gravure process.

A slipping layer may be used on the back side of the dye-donor element to prevent the printing head from sticking to the dye-donor element. Such a slipping layer would comprise either a solid or liquid lubricating material or mixtures thereof, with or without a polymeric binder or a surface-active agent. Preferred lubricating materials include oils or semi-crystalline organic solids that melt below 100° C. such as poly(vinyl stearate), beeswax, perfluorinated alkyl ester polyethers, poly-caprolactone, silicone oil, poly (tetrafluoroethylene), carbowax, poly(ethylene glycols), or any of those materials disclosed in U.S. Pat. Nos. 4,717,711; 4,717,712; 4,737,485; and 4,738,950. Suitable polymeric binders for the slipping layer include poly(vinyl alcohol-co-butyral), poly(vinyl alcohol-co-acetal), polystyrene, poly (vinyl acetate), cellulose acetate butyrate, cellulose acetate propionate, cellulose acetate or ethyl cellulose.

The amount of the lubricating material to be used in the slipping layer depends largely on the type of lubricating material, but is generally in the range of about 0.001 to about 2 g/m$^2$. If a polymeric binder is employed, the lubricating material is present in the range of 0.05 to 50 weight %, preferably 0.5 to 40 weight %, of the polymeric binder employed.

Any material can be used as the support for the dye-donor element provided it is dimensionally stable and can withstand the heat of the thermal printing heads. Such materials include polyesters such as poly(ethylene terephthalate); polyamides; polycarbonates; glassine paper; condenser paper; cellulose esters such as cellulose acetate; fluorine polymers such as poly(vinylidene fluoride) or poly(tetrafluoroethylene-co-hexafluoropropylene); polyethers such as polyoxymethylene; polyacetals; polyolefins such as polystyrene, polyethylene, polypropylene or methylpentene polymers; and polyimides such as polyimide amides and polyetherimides. The support generally has a thickness of from about 2 to about 30 μm.

The dye-receiving element that is used with the dye-donor element usually comprises a support having thereon a dye image-receiving layer. The support may be a transparent film such as a poly(ether sulfone), a polyimide, a cellulose ester such as cellulose acetate, a poly(vinyl alcohol-co-acetal) or a poly(ethylene terephthalate). The support for the dye-receiving element may also be reflective such as baryta-coated paper, polyethylene-coated paper, white polyester (polyester with white pigment incorporated therein), an ivory paper, a condenser paper or a synthetic paper such as DuPont Tyvek®.

The dye image-receiving layer may comprise, for example, a polycarbonate, a polyurethane, a polyester, poly (vinyl chloride), poly(styrene-co-acrylonitrile), polycaprolactone or mixtures thereof. The dye image-receiving layer may be present in any amount that is effective for the intended purpose. In general, good results have been obtained at a concentration of from about 1 to about 5 g/m$^2$.

As noted above, the dye donor elements used in the present process are used to form a dye transfer image. Such a process comprises imagewise heating a dye-donor element as described above and transferring a dye image to a dye receiving element to form the dye transfer image. After the dye image is transferred, the protection layer is then transferred on top of the dye image.

The dye donor element may be used in sheet form or in a continuous roll or ribbon. If a continuous roll or ribbon is employed, it may have only one dye or may have alternating areas of other different dyes, such as sublimable cyan and/or magenta and/or yellow and/or black or other dyes. Thus, one-, two-, three- or four-color elements (or higher numbers also) are included within the scope of the invention.

The dye-donor element may comprise a poly(ethylene terephthalate) support coated with sequential repeating areas of yellow, cyan and magenta dye, and the protection layer noted above, and the above process steps are sequentially performed for each color to obtain a three-color dye transfer image with a protection layer on top. Of course, when the process is only performed for a single color, then a monochrome dye transfer image is obtained.

Thermal printing heads that can be used to transfer dye and a protection overcoat from dye-donor elements are available commercially. There can be employed, for example, a Fujitsu Thermal Head FTP-040 MCSOO1, a TDK Thermal Head LV5416 or a Rohm Thermal Head KE 2008-F3.

A thermal dye transfer assemblage typically comprises (a) a dye-donor element as described above, and (b) a dye-receiving element as described above, the dye receiving element being in a superposed relationship with the dye donor element so that the dye layer of the donor element is in contact with the dye image-receiving layer of the receiving element.

The above assemblage comprising these two elements may be preassembled as an integral unit when a monochrome image is to be obtained. This may be done by temporarily adhering the two elements together at their margins. After transfer, the dye-receiving element is then peeled apart to reveal the dye transfer image.

When a three-color image is to be obtained, the above assemblage is formed on three occasions during the time when heat is applied by the thermal printing head.

After the first dye is transferred, the elements are peeled apart. A second dye-donor element (or another area of the donor element with a different dye area) is then brought in register with the dye-receiving element and the process is repeated. The third color is obtained in the same manner. Finally, the protection layer is applied on top.

Referring now to FIG. 1, one embodiment for carrying out the method of the present invention using a thermal print head is illustrated. During the printing operation, the following components are employed: a thermal print head 1 which also has an IC (integrated circuit) cover 2 attached for the protection on the thermal head integrated circuitry, an attached heat sink 3 to dissipate heat from the thermal head, a single compression spring 4 (or multiple compression springs) to apply the correct pressure for transfer of ink or dye, a method for causing the spring or springs to be compressed which creates the pressure, in this case a driven compression plate 5, a method to drive the compression plate to provide compression such as a drive cam 7. The ink ribbon which carries the ink or dye is supplied by a ribbon supply spool 10 to provide fresh, unused ink. The used or depleted portion of the ink ribbon after printing is taken up by ribbon take-up spool 11. (A patch for the transparent overcoat material can be on the same ribbon as the ink or dye patches for transfer, or the overcoat material can be on a separate ribbon, although for simplicity the ribbon having the overcoat patch will be referred to as the "ink" ribbon. For proper conveyance of the ink ribbon web, there may be one or more than one guide rollers for proper steering, first ribbon guide roller 8 and second ribbon guide roller 9. The ink or dye is transfer to a receiver sheet that is on a pre-print paper driven path 12 and printed paper driven path 14. This assembly is driven in to contact with an elastomer roller typically called a platen roller 13. During printing, the used or depleted ink ribbon holding the transparent overcoat layer is peeled from the receiver sheet, leaving the overcoat on the receiver sheet. The peeling is accomplished through the use of a stripping plate or similar means such as a peeling plate, nose piece or the like. The peeling plate may be directly attached to the heat sink or to the compression plate, and both are at a set position with respect to the platen roller, receiver paper, ink ribbon and thermal head during printing. The means for stripping typically has a radius edge for applying pressure at the point of peeling without damage to the moving web or ribbon.

For example, in a thermal printer an 18-mm diameter platen roller, having a horizontal distance of stripper plate to the platen roller center line of 4.8 mm, the vertical distance of stripper plate to the platen roller tangent point is −1.38 mm, preferably distance from a true horizontal line between the thermal head and platen roller is 0.1 mm to −0.5 mm, most preferably about −0.35 mm. This results in a deviation from the nominal manufacturing set point of the stripper plate on a KODAK Photo Printer to equal −0.15 mm. In the case of −1.38 mm, the arc length between the horizontal tangent point and vertical tangent Point is 5.062 mm. In such a case, the smallest angle between platen roller and the stripper plate is 0 degrees, which is a true horizontal line, and the largest angle from a true horizontal line between the platen roller and stripper plate is 32.14 degrees. Consistent with these dimensions, the preferred angle between platen roller and stripper plate is 1.19 to 3.58 degrees.

EXAMPLES

Printing

This example shows improved gloss from adjustment of stripper plate assembly according to the present invention. Using KODAK Photo Printer® Kit 6400 (Eastman Kodak Co. Catalog No. 180-2016) receiver with the test color ribbon given below and a KODAK Photo Printer® 6400, a Status A neutral density image with a maximum density of at least 2.3 was printed on the receiver described above.

The color ribbon-receiver assemblage was positioned on an 18 mm platen roller and a thermal print head with a load of 3.18 Kg pressed against the platen roller. The thermal print head has 1844 independently addressable heaters with a resolution of 300 dots/inch and an average resistance of 4800 ohms. The imaging electronics were activated when an initial print head temperature of 37° C. had been reached. The assemblage was drawn between the printing head and platen roller at 70.5 mm/sec (1.2 ms line time) for yellow, magenta and cyan, 42 mm/sec (2.0 ms line time) for clear protective coat layer. Printing maximum density required a duty cycle of 90% "on" time per printed line.

The voltage supplied was 25 volts resulting in an instantaneous peak power of approximately 0.131 Watts/dot and the maximum total energy required to print Dmax was 0.1216 mJoules/dot for the sequential printing process of yellow, magenta, cyan and 0.2026 mJoules/dot for clear protective coat layer to obtain the desired neutral image.

In addition to the printing head and platen roller, a metal plate was positioned past the print head/platen interface to peel or strip the color ribbon from the receiver. Testing was conducted by changing the distance, or time, that the color ribbon is kept in contact with the receiver and measuring the gloss level.

The laminate formulations used in this aspect of the formulation are those described below The gloss was determined at sixty degrees using a BYK-Gardner micro-TRI-gloss meter. The aperture of the gloss meter was placed perpendicular to the direction of printing.

Donor Element

Protection layer donor elements were prepared by coating on the back side of a 6 μm poly(ethylene terephthalate) support:

1) a subbing layer of titanium alkoxide, Tyzor TBT®, (DuPont Corp.) (0.13 g/m$^2$) from a n-propyl acetate and n-butyl alcohol solvent mixture (85/15), and
2) a slipping layer containing an aminopropyl-dimethyl-terminated polydimethylsiloxane, PS513® (United Chemical Technologies) (0.01 g/m$^2$), a poly(vinyl acetal) binder, KS-1, (Sekisui Co.), (0.38 g/m$^2$), p-toluenesulfonic acid (0.0003 g/m$^2$) and candellila wax (0.02 g/m$^2$) coated from a solvent mixture of 3-pentanone, methanol and distilled water (88.7/9.0/2.3).

On the front side of the element was coated a transferable overcoat layer of poly(vinyl acetal), KS-10, (Sekisui Co.), at a laydown of 0.63 g/m$^2$, colloidal silica, IPA-ST (Nissan Chemical Co.), at a laydown of 0.46 g/m$^2$, 4 μm divinylbenzene beads at a laydown of 0.11 g/m$^2$ and CGP1644 (Ciba Corp), a triazine UV absorber, at a laydown of 0.11 g/m$^2$. The materials were coated from the solvent 3-pentanone.

Table 1 below shows increased Gloss as a result of stripper plate position or increased time to peel.

TABLE 1

| Stripper Plate Position | Change (Deviation) in Stripper Plate from Nominal Manufacturing Position | Time in milliseconds | Average Gloss Measurement |
|---|---|---|---|
| 1 | +0.1 mm | 68.046 | 67 |
| 2 | 0.0 mm | 68.091 | 67 |
| 3 | −0.1 mm | 68.164 | 67 |
| 4 | −0.2 mm | 68.267 | 70 |
| 5 | −0.3 mm | 68.400 | 70 |

The data in Table 1 above indicates that a change in the stripper plate position such that the time between printing and peeling of the donor and receiver results in an increased gloss. During experimentation, the stripper plate position with respect to the thermal print head, ink ribbon, receiver paper and platen roller was adjusted using a fixture. Table 1 shows that position 2 of the stripper plate is the nominal manufacturing position and, therefore, the deviation from normal manufacturing procedures on the KODAK Photo Printer 6400 is 0.0 mm. Position 1 moves the stripper plate position upwards, or away from the platen roller. Positions 3 through 5 moves the stripper plate downwards, or closer to the platen roller. By moving the stripper plate position vertically down, the actual distance between the thermal head and stripper plate is increased. This increases in length also translates into an increase in time between printing and stripping or peeling of the ribbon and the receiver paper. Thus, in particular, testing has indicated that by maintaining, within a certain range, the time that the color ribbon is kept in contact with the receiver increases the gloss level.

PARTS LIST 1 thermal print head
2 IC (integrated circuit) cover
3 heat sink
4 compression spring
5 driven compression plate
6 stripping plate
7 drive cam
8 first guide roller
9 second guide roller
10 ribbon supply spool
11 ribbon take-up spool
12 pre-print paper driven path
13 platen roller
14 printed paper driven path

What is claimed is:

1. A process of forming a protection layer with an improved level of gloss on top of a thermal dye transfer image comprising:

(a) imagewise heating a dye-donor element comprising a support having thereon a dye layer comprising an image dye in a binder, said dye donor being in contact with a dye-receiving element, thereby transferring a dye image to said dye-receiving element at a line time of 0.4 to 2 milliseconds to form said dye transfer image; and (b) non-imagewise heating a donor element, which may be the same as the dye-donor element or a separate donor-element, which donor element comprises a support and a protection layer, thereby thermally transferring the protection layer on top of said transferred dye image at a line time of 0.4 to 2 milliseconds, wherein a means for stripping the protection layer from the donor element is adjusted so that the distance the donor element and receiver travel before peeling is preselected such that the time from printing of a line to peeling of the line, when the donor substrate is separated from the protection layer adhered to said printed dye-receiving element, is 68.21 to 69.00 milliseconds.

2. The process of claim 1 wherein the time from printing of a line to peeling of the line, when the support of the donor element is separated from the protection layer adhered to said dye-receiving element is preferably 68.25 to 68.75 milliseconds.

3. The process of claim 1 wherein an angle between donor element and dye-receiving element is present at time of peeling is 1.19 degrees to 2.39 degrees.

4. The process of claim 1 wherein the line times in both (a) and (b) is preferably less than 1.4 milliseconds and an angle is present between donor element and thermal print at time of peeling that is between 0 and 32.14 degrees.

5. The process of claim 1 wherein the Tg of the surface material on the protection layer in contact with the thermal print is in the range of 100 to 125° C.

6. The process of claim 1 wherein the Tg of the surface material on the protection layer in contact with the print is below 120° C., preferably 110 to 120° C.

7. The process of claim 1 wherein the protective layer is heated by a thermal print head at a temperature of 130 to 150° C.

8. The process of claim 1 wherein the thermal print has a gloss level of at least 70.

9. The process of claim 1 wherein said means for stripping the protection layer from the dye-donor element is a printer stripper plate.

10. The process of claim 9 wherein the printer stripper plate is connected directly to a thermal head heat sink or a thermal print head compression plate.

11. The process of claim 1 wherein a single thermal print head is used in (a) and (b).

12. The process of claim 1 wherein at least the surface material of said protection layer comprises a polymer represented by the following structure:

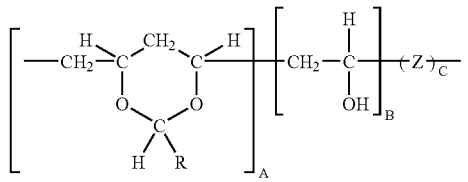

wherein:

R is H, $CH_3$ or $C_6H_5$;

A is at least about 25 mole percent;

B is from about 5 to about 75 mole percent;

Z is another monomer different from A and B such as vinyl acetate, vinyl chloride, styrene, methyl methacrylate, butyl acrylate, isopropyl acrylamide, and acrylate ionomer;

A+B is at least about 65 mole percent; and

A+B+C=100.

13. The process of claim 1 wherein at least the surface material of said protection layer comprises a polymer selected from the group consisting of poly(vinyl formal), poly(vinyl benzal) or poly(vinyl acetal) containing at least about 5 mole % hydroxyl, poly(vinyl)butyral, and poly (methylmethacrylate), and combinations thereof.

14. The process of claim 13 wherein at least the surface material of said protection layer comprises poly(vinyl acetal).

15. The process of claim 1 wherein said dye-donor element is a multicolor element comprising repeating color patches of yellow, magenta and cyan image dyes, respectively, dispersed in a binder, and a patch containing said protection layer.

16. The process of claim 1 wherein separate thermal print heads are employed for imagewise heating in step (a) and non-imagewise heating in step (b).

17. The process of claim 16 wherein a plurality of separate thermal print heads are employed for imagewise heating, respectively, a plurality of color patches in step (a).

* * * * *